US008789582B2

(12) United States Patent
Rondeau et al.

(10) Patent No.: US 8,789,582 B2
(45) Date of Patent: Jul. 29, 2014

(54) APPARATUS AND METHODS FOR WELL CEMENTING

(75) Inventors: Joel Rondeau, Antony (FR); Andre Salvaire, Montigny le Bretonneux (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 12/850,168

(22) Filed: Aug. 4, 2010

(65) Prior Publication Data

US 2012/0031614 A1 Feb. 9, 2012

(51) Int. Cl.
*E21B 33/12* (2006.01)

(52) U.S. Cl.
USPC ..... 166/153; 166/250.04; 166/386

(58) Field of Classification Search
USPC ..... 166/285, 250.14, 153, 177.4, 181, 386, 166/250.04
See application file for complete search history.

(56) References Cited

U.S. PATENT DOCUMENTS

| | | | | |
|---|---|---|---|---|
| 650,256 | A | 5/1900 | Lewis et al. | |
| 5,092,406 | A | 3/1992 | McStravick | |
| 5,131,473 | A | 7/1992 | Fischer | |
| 5,346,011 | A * | 9/1994 | Onan et al. | 166/291 |
| 5,413,172 | A * | 5/1995 | Laurel | 166/153 |
| 5,553,667 | A * | 9/1996 | Budde et al. | 166/70 |
| 7,472,753 | B2 * | 1/2009 | Mondelli et al. | 166/291 |
| 2002/0033262 | A1 * | 3/2002 | Musselwhite et al. | 166/285 |
| 2006/0000993 | A1 | 1/2006 | Kirk et al. | |
| 2008/0283244 | A1 * | 11/2008 | Barbee | 166/285 |

FOREIGN PATENT DOCUMENTS

EP 0450676 3/1991

OTHER PUBLICATIONS

Arnold ES: "Cementing: Bridging the Gap from Laboratory Results to Field Operations," Journal of Petroleum Technology (Dec. 1982) 34, No. 12, 2843-2852.
Beirute RM: "The Phenomenon of Free Fall During Primary Cementing," paper SPE 13045 presented at the SPE Annual Technical Conference and Exhibition, Houston, Texas, USA (Sep. 16-19, 1984).
Brandt W et al.: "Deepening the Search for Offshore Hydrocarbons." Oilfield Review (Spring 1998) 10, No. 1, 2-21.
Brown D and Ferg T: "The Use of Lightweight Cement Slurries and Downhole Chokes on Air-Drilled Wells," paper SPE 84561 presented at the SPE Annual Technical Conference and Exhibition, Denver, Colorado, USA (Oct. 5-8, 2003).
Kelessidis VC et al.: "Simulator Models 'U-tubing' to Improve Primary Cementing," Oil & Gas Journal (Mar. 9, 1994) 92, No. 10, 72-80.
Leugemors E, Metson J, Pessin J.-L, Colvard RL, Krauss CD and Plante M: "Cementing Equipment and Casing Hardware," in Nelson EB and Guillot D (eds.): Well Cementing—2nd Edition, Houston: Schlumberger (2006): 343-434.
Piot B and Cuvillier G: "Primary Cementing," in Nelson EB and Guillot D (eds.): Well Cementing—2nd Edition, Houston: Schlumberger (2006): 459-501.
Wahlmeier M and Lam S: "Mathematical Algorithm Aids Analysis of 'U-Tubing' During Slurry Placement," Oil & Gas Journal (Jan. 7, 1985) 83, No. 1, 80-86.

* cited by examiner

*Primary Examiner* — Yong-Suk (Philip) Ro
(74) *Attorney, Agent, or Firm* — Michael Dae

(57) ABSTRACT

An apparatus for regulating fluid-flow during a primary cementing job comprises a bottom cementing plug, adapted to house a one-way valve and means to regulate fluid flow through the plug interior. The apparatus is useful for minimizing or preventing free fall or U-tubing during primary cementing. The apparatus is compatible with conventional cementing-plug launching systems.

11 Claims, 3 Drawing Sheets

APPARATUS AND METHODS FOR WELL CEMENTING

BACKGROUND

The statements in this section merely provide background information related to the present disclosure and may not constitute prior art.

Embodiments are related in general to equipment for servicing subterranean wells. Particularly, the invention relates to an apparatus and methods for controlling the direction and rate at which fluids flow during the primary cementation of a subterranean well.

During a primary cement job, fluids of various densities are circulated through the tubulars, the annular region between the tubulars and the borehole wall, and sometimes the annular regions between two tubular bodies. Most of the time, fluids first travel through the interior of the tubulars. Upon exiting the tubulars, the fluids travel through the annular region between the exterior surface of the tubulars and the borehole wall. Fluids may flow in the opposite direction should operators choose a procedure known in the art as "reverse cementing." The tubulars may include drill pipe, casing, liner and coiled tubing. Hereinafter, the common term "casing" shall be used to describe a tubular body.

Typically, each fluid is heavier (higher in density) than its predecessor. For example, a spacer fluid is usually heavier than the drilling fluid, and a cement slurry is usually heavier than the spacer fluid. This density hierarchy helps minimize commingling between fluids as they circulate in the well. The density difference also promotes efficient removal of drilling fluid, providing clean casing- and borehole-wall surfaces to which the cement may bond and provide zonal isolation.

A potential consequence of the fluid-density hierarchy is a phenomenon known in the art as free fall or "U-tubing." The fluids inside the casing and the annulus will naturally tend to achieve a hydrostatic equilibrium. When a heavier fluid such as a cement slurry is introduced inside the casing, a hydrostatic imbalance is created between the casing interior and the annulus. As a result, the cement slurry has a tendency to free fall and draw a vacuum inside the upper part of casing interior. Practitioners of the art will of course recognize that the free-fall tendency may be lessened by friction pressures inside and outside of the casing.

Nevertheless, during many cementing operations, the pump rate into the casing is insufficient to keep the casing full during the early part of the job. This results in a net flow or efflux of fluid out of the annulus. The rate of efflux may be much higher than the inward flow. Eventually, as hydrostatic pressure equilibrium is approached, the rate of efflux from the well falls below the inward-flow rate, and the casing interior gradually refills.

Those skilled in the art recognize that optimal cementing results may not be obtained unless the fluid-flow rate in the well is controlled. Owing to the fluids' rheological properties, an annular-flow rate that is too high or too low may cause poor drilling-fluid removal and compromise zonal isolation.

If a lower-density displacement fluid follows the cement slurry, a second U-tubing event may occur, but in the opposite direction. Cement slurry would re-enter the casing interior, causing a situation known as "cement left in pipe" or CLIP. In addition the cement slurry may no longer cover the annulus across a producing interval, resulting in the loss of zonal isolation.

Hydrostatic imbalances in the well also have implications in the context of foamed cements. When pumping foam there is no free fall per se because the pressure cannot fall to zero at the wellhead. Nevertheless, as the casing-interior pressure falls, the gas volume in the foam (i.e., foam quality) will increase. The foam may collapse if the foam quality reaches the point of instability.

The beginning and end of U-tubing events may be detected by measuring the surface pressure during the cement job. Considering the importance of annular-fluid velocities and pressures to the safe and successful execution of a cement job, it is clear that U-tubing must be considered in any job design. Algorithms exist that permit engineers to simulate the phenomenon.

The well-cementing industry has introduced techniques and devices that address the U-tubing phenomenon. One technique is to control the "back-side" or annular pressure, thereby counterbalancing the internal-casing pressure and reducing free fall. However, this is often not practical, especially in remote locations or if the required back-side pressure is excessive.

Various devices for controlling fluid-flow in a subterranean well have been described (see for example U.S. Pat. No. 5,092,406; U.S. Pat. No. 5,131,473; U.S. Pat. No. 6,520,256; and US 2006/0000993). The devices include downhole chokes and an apparatus that forces fluids to travel through a tortuous path. These devices control the rate at which fluids pass through them, thereby controlling the flow rate in the casing and the annulus. The devices are premounted on or inside the casing string. Once the casing is lowered into the well, fluid-flow control is immediately limited.

Despite the valuable contributions of the prior art, a need remains for operators to freely circulate fluids after the casing is lowered in the well; for example, to condition the annulus and remove gelled drilling fluid that may be coating the exterior casing wall and the borehole wall. The presence of gelled drilling fluid in the annulus is detrimental to achieving a successful primary cementing job. At higher flow rates, hole conditioning is generally more efficient.

In addition, circulating at higher rates may be essential to maintain well control if for example (1) the casing collapses; (2) the surface pressure becomes too high for the cement head; or (3) the hydraulic-horsepower limit of the pumps is reached.

It would also be desirable to delay the maximum-fluid-rate decision until just before the cement job takes place. Such a feature would allow operators to make last minute slurry-density or fluid-composition adjustments in response to current well conditions.

SUMMARY

Some embodiments provide the aforementioned needs.

Aspects relate to an apparatus for regulating fluid flow during primary cementing of a subterranean well.

Other aspects relate to methods for regulating fluid flow during primary cementing of a subterranean well.

Yet other aspects relate to methods for cementing a subterranean well.

All aspects of the embodiments may be applied in oil and gas wells, geothermal wells, water wells, and wells for chemical waste disposal, enhanced recovery of hydrocarbons and carbon sequestration.

DETAILED DESCRIPTION

Figure 1:
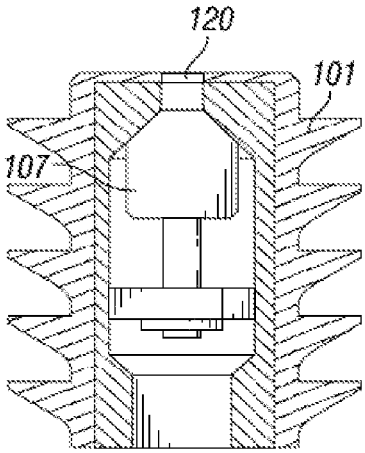
FIG. 1 illustrates the design of one embodiment involving a one-way valve and means for adjusting the maximum fluid-flow rate.

Embodiments provide an apparatus and methods by which free fall, or U-tubing, may be minimized or prevented during a primary cementing job. Some embodiments enable operators to freely circulate fluids in the well prior to the cement job, and delay decisions regarding the maximum fluid-flow rate until just prior to the cement job.

When cementing the annular space between casing and the walls of a subterranean wellbore, it is usually necessary to minimize or prevent the commingling of the drilling fluid, spacer fluid and cement slurry. Commingling may result, for example, in adverse rheological effects, dilution and/or contamination of the cement slurry and compromised zonal isolation.

One way to minimize commingling involves using wiper plugs to separate fluids as they travel down the casing. Wiper plugs also clean the inner surface of the casing. Most cementing operations involve two wiper plugs: a bottom plug that separates cement slurry from drilling fluid, and a top plug that separates cement slurry from displacement fluid.

After the casing is installed in the wellbore, the annulus between the casing and the wellbore wall (or another casing string) is usually filled with drilling fluid. When primary cementing begins, the bottom plug is first launched into the casing, followed by the cement slurry. The cement slurry may be preceded by a spacer fluid, a chemical wash or both. The function of the bottom plug is to scrape traces of drilling fluid from the internal surface of the casing, and to prevent contact between the drilling fluid and the cement slurry.

The bottom-plug launching and conveyance through the casing arises from pressure applied by the cement slurry. When the bottom plug completes its journey through the casing, it becomes seated on float equipment installed at the bottom of the casing. Continued pumping exerts sufficient pressure to rupture a membrane at the top of the bottom plug, allowing the cement slurry to flow through an interior passage in the bottom plug, exit the bottom of the casing and continue into the annulus.

After sufficient cement slurry to fill the annulus has been pumped into the casing, the top plug is launched into the casing, and a displacement fluid is pumped behind the plug. The displacement fluid forces the plug through the casing. The function of the top plug is generally to scrape traces of cement slurry from the internal surface of the casing, isolate the cement slurry from the displacement fluid and, upon landing on the bottom plug, seal the casing interior from the annulus. Unlike the bottom plug, the top plug has no membrane or interior passage through which fluids may flow.

A thorough description of the primary cementing process and the equipment employed to perform the service may be found in the following references. (1) Piot B. and Cuvillier G.: "Primary Cementing," in Nelson E. B. and Guillot D. (eds.): *Well Cementing*-2$^{nd}$ Edition, Houston: Schlumberger (2006): 459-501. (2) Leugemors E., Metson J., Pessin J.-L., Colvard R. L., Krauss C. D. and Plante M.: "Cementing Equipment and Casing Hardware," in Nelson E. B. and Guillot D. (eds.): *Well Cementing*-2$^{nd}$ Edition, Houston: Schlumberger (2006): 343-434.

Wiper plugs are usually launched from a cementing head that is attached to the casing near the drilling rig. The casing generally rises from the bottom of the open hole to the rig floor. In case of subsea completions, the problem usually becomes more complicated, and fluid isolation becomes more and more critical as water depth increases. It thus becomes impractical to launch wiper plugs from the surface. Therefore, the cementing head containing the wiper plugs rests on the seafloor, and the top of the casing ends at the mudline. Drillpipe connects the top of the casing to the rig floor on the surface. During the cementing process, darts are commonly released into the drillpipe on surface, travel through the drillpipe to the seafloor and, upon arrival, trigger the release of the wiper plugs.

After the first dart is launched, cement slurry is pumped behind it. When the first dart lands inside the cementing head, it triggers the release of the bottom plug. A second dart is then launched after sufficient cement slurry has been pumped to fill the annulus. A displacement fluid is generally pumped behind the second dart. When the second dart arrives it triggers the release of the top plug. A brief peak in surface pressure indicates when each wiper plug has been launched. This process is detailed, for example, in the following references: (1) Buisine P. and Lavaure G.: "Equipment for Remote Launching of Cementing Plugs into Subsea Drilled Wells," European Patent Application 0 450 676 A1 (1991); (2) Brandt W. et al.: "Deepening the Search for Offshore Hydrocarbons." *Oilfield Review* (Spring 1998) 10, No. 1, 2-21.

An advantage of the apparatus is that it can be deployed in the same manner as a cementing plug, and can be compatible with the aforementioned plug-launching sequence.

In a first aspect, the invention relates to an apparatus that controls the flow direction and flow rate of fluids during, for example, a primary-cementing operation. As apparent from FIG. 1: the apparatus of the invention comprises a U-tube-control plug 101. The plug is preferably similar to a bottom cementing plug; however, the interior of the body is fitted with a one-way valve 107. Means for regulating the fluid-flow rate may comprise an adjustable one-way valve. For example, the displacement distance of the valve may be varied. Alternatively, an independent device for adjusting flow rate may be incorporated. Such independent devices may comprise nozzles, valves and/or orifices. In the manner of a bottom plug, a membrane 120 at the top of the U-tube-control plug ruptures when the plug becomes seated at the bottom of the casing string. As process fluid enters the interior of the plug, the one-way valve allows fluid flow in the downward direction, away from the pumping equipment, but prevents process-fluid flow in the opposite direction. Furthermore, the one-way valve, independent device or both may be preadjusted such that the fluid flow rate through the plug can be limited to a desired rate, thereby preventing the U-tube phenomenon. Means are also envisioned to allow flow-rate adjustments as needed during the cementing job, after the apparatus is deployed in the well.

Figure 2A:
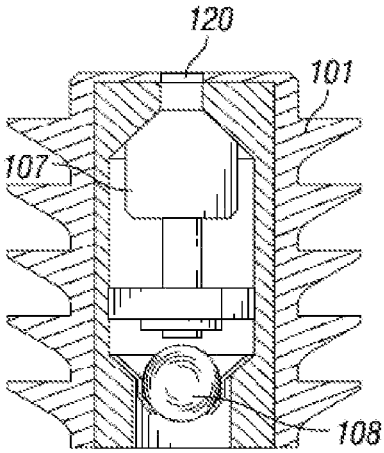
FIG. 2 illustrates the design of further embodiments that further comprises a ball for activating a float collar.
Figure 2B:
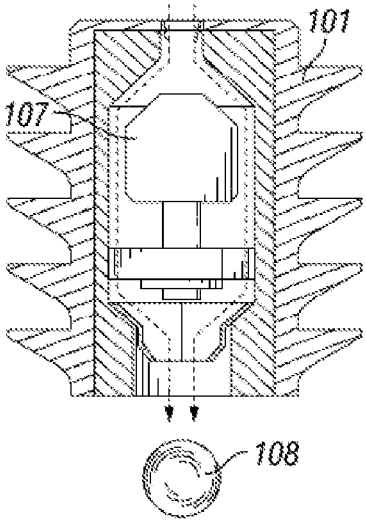

Optionally, the U-tube-control plug 101 may include a releasable device such as for example a ball 108, housed under the one-way valve 107 (FIG. 2A). When the plug lands on the float collar at the end of the casing, the plug membrane 120 ruptures and process fluid begins flowing into the plug and past the one-way valve. The releasable device is at this point released to activate the float collar (FIG. 2B).

Figure 3:
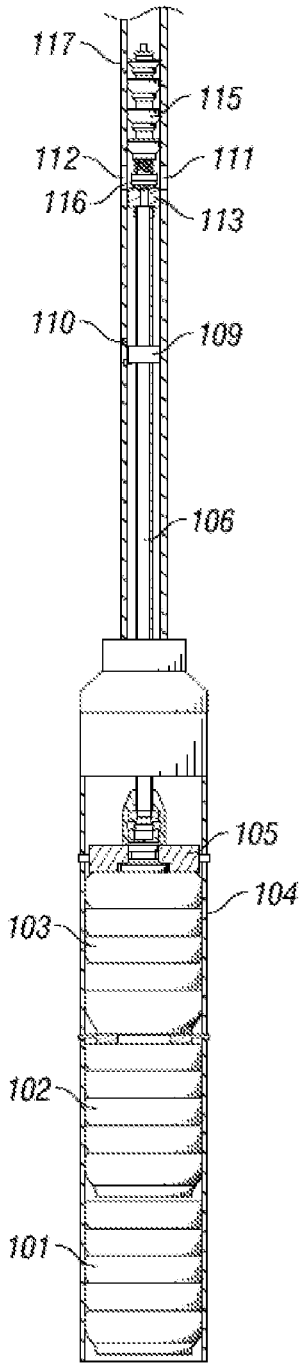
FIG. 3 illustrates how some embodiments may be mounted in a plug-launching apparatus.

As shown in FIG. 3, the U-tube-control plug 101 is designed to be compatible with a conventional bottom plug 102 and top plug 103, and may be installed in a plug basket 104 below the bottom plug and top plug. The one-way valve inside the U-tube-control plug may be adjusted such that, once activated, fluid flow through the plug would be limited to a desired rate. In addition to the one-way valve, an independent fluid-flow-limiting device may be present. A piston 105 is driven by a main rod 106, equipped with a rod head 116. Below the rod head 116 is a movable sleeve 113. Another movable sleeve 109 with a shear pin 110 is preferably installed further below the movable sleeve 113. The distance between the movable sleeves 113 and 109 is generally equal to the length of a dart 115—in this figure the U-tube-control-plug dart. Above the rod head 116, there are flow ports (111 and 112) in a tubular body 117, through which process fluids may flow. The apparatus of FIG. 3 will hereinafter be called the plug-launching system.

Those skilled in the art will understand that use of the apparatus not limited to the particular plug-launching system of FIG. 3. Those skilled in the art will also understand that process fluids may comprise drilling fluids, cement slurries, chemical washes, spacer fluids and completion fluids.

In another aspect, embodiments relate to a method for regulating fluid flow during the primary cementing of a subterranean well. The method is exemplified in FIG. 4.

Figures 4A, 4B, 4C, 4D:
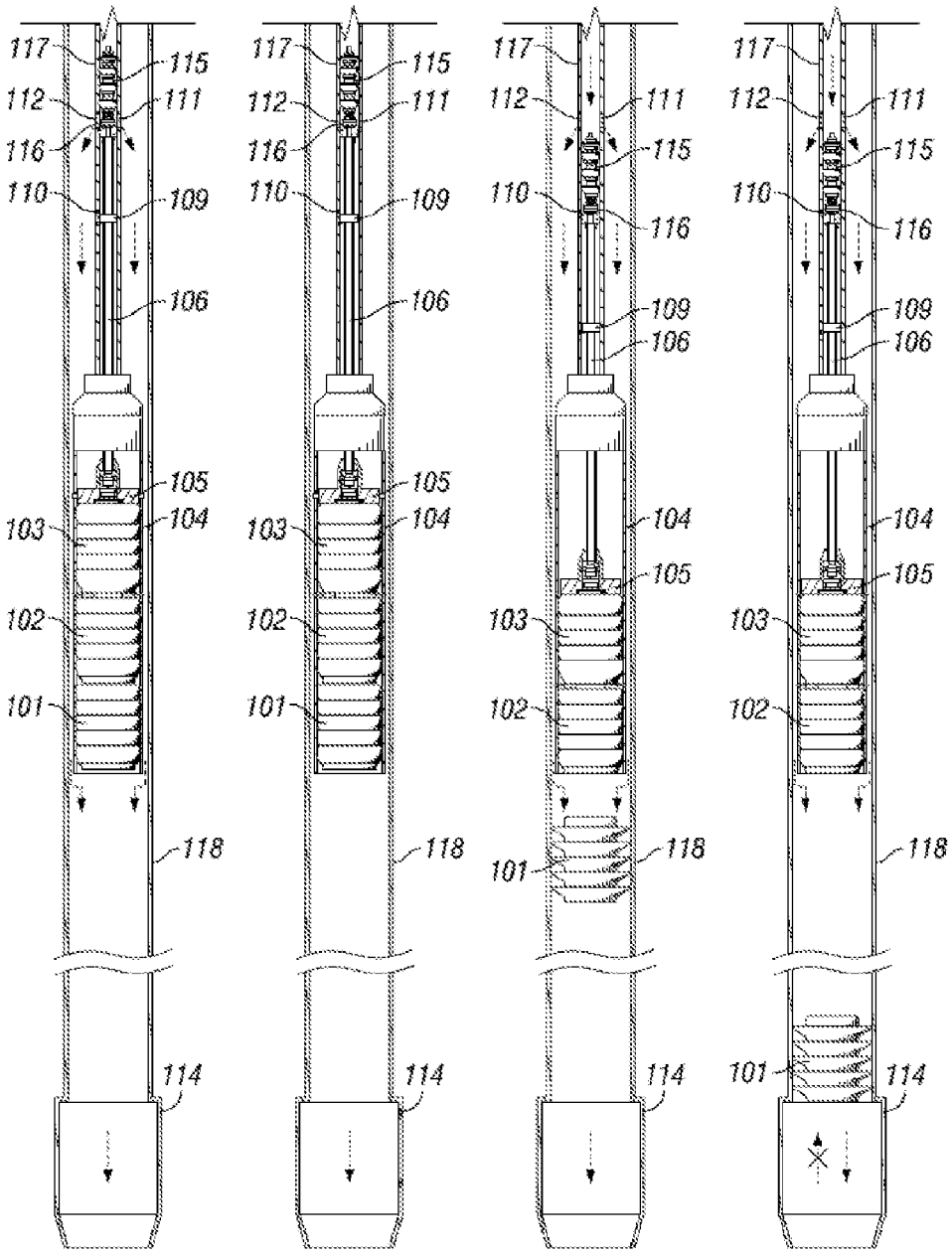
FIG. 4 illustrates how embodiments can be operated during a primary cementing job.

After assembly, the plug-launching system of FIG. 3 may be installed inside a casing string 118 (FIG. 4A). Outside of the casing string is an annular region (not shown). The other side of the annular region may comprise the borehole wall or another casing string. A first process fluid flows through the first tubular body 117 and out through ports 111 and 112 into the annulus between the first tubular body and the casing interior. Process fluid bypasses the plug-launching system, and then flows toward the float collar 114 at the end of the casing string. The U-tube-control dart of the invention 115 has been launched into the process-fluid stream from an upstream location such as the wellhead.

FIG. 4B depicts the moment at which the U-tube-control dart 115 lands on rod head 116, installed on main rod 106. The dart obstructs fluid flow through ports 111 and 112. As shown in FIG. 4C, further pumping of process fluid forces the bottom dart downward, thereby forcing the rod 106 downward, thereby causing the piston 105 to move downward and eject the U-tube-control plug of the invention 101 from the plug basket 104. The U-tube-control dart clears the ports 111 and 112, allowing process fluid to exit the plug launching apparatus and reestablish flow outside the plug launching system.

FIG. 4D shows the moment at which the U-tube-control plug 101 lands on the float collar 114. Continued pumping of process fluid causes the plug membrane 120 to rupture, allowing fluid to enter and flow through the plug. This activates the one-way valve and, from now on, fluid-flow in the opposite direction is prevented. In addition the one-way valve, an independent device or both may limit the fluid-flow rate through the apparatus. The flow-rate adjustment may be performed before the U-tube-control plug is installed, or remotely during the cement job. Optionally, when fluid flow commences inside the U-tube-control plug, a releasable device 108 may be released for activating the float collar, such releasable device may be a ball.

In yet another aspect, the invention relates to a method for cementing a subterranean well. The method is exemplified in FIG. 4.

After assembly, the plug-launching system of FIG. 3 may be installed inside a casing string 118 (FIG. 4A). Outside of the casing string is an annular region (not shown). The other side of the annular region may comprise the borehole wall or another casing string. Drilling fluid flows through the first tubular body 117 and out through ports 111 and 112 into the annulus between the first tubular body and the casing interior. The drilling fluid bypasses the plug-launching system, and then flows toward the float collar 114 at the end of the casing string. The U-tube-control dart of the invention 115 has been launched into the drilling-fluid stream from an upstream location such as the wellhead.

FIG. 4B depicts the moment during which the U-tube-control dart 115 lands on rod head 116, installed on main rod 106. The dart obstructs fluid flow through ports 111 and 112. As shown in FIG. 4C, further pumping of drilling fluid forces the bottom dart downward, thereby forcing the rod 106 downward, thereby causing the piston 105 to move downward and eject the U-tube-control plug of the invention 101 from the plug basket 104. The U-tube-control dart clears the ports 111 and 112, allowing drilling fluid to exit the plug launching apparatus and reestablish flow outside the plug launching system.

FIG. 4D shows the moment at which the U-tube-control plug 101 lands on the float collar 114. Continued pumping of drilling fluid causes the plug membrane 120 to rupture, allowing fluid to enter and flow through the plug. This activates the one-way valve and, from now on, fluid-flow in the opposite direction is prevented. In addition the one-way valve, an independent device or both may limit the fluid-flow rate through the apparatus. The flow-rate adjustment may be performed before the U-tube-control plug is installed, or remotely during the cement job. Optionally, when fluid flow commences inside the U-tube-control plug, a releasable device (such as for example a ball) 108 may be released for activating the float collar.

The cementing process may then continue in the manner well known in the art, whereby the bottom plug 102 and top plug 103 are launched by the arrivals of the bottom dart and top dart.

All aspects may be applied in oil and gas wells, geothermal wells, water wells, and wells for chemical waste disposal, enhanced recovery of hydrocarbons and/or carbon sequestration.

The preceding description has been presented with reference to some illustrative embodiments of the invention. Persons skilled in the art and technology to which this invention pertains will appreciate that alterations and changes in the described structures and methods of operation can be practiced without meaningfully departing from the principle, and scope of this invention. Accordingly, the foregoing description should not be read as pertaining only to the precise structures described and shown in the accompanying drawings, but rather should be read as consistent with and as support for the following claims, which are to have their fullest and fairest scope.

The invention claimed is:

1. A method for regulating flow of a fluid during primary cementing of a subterranean well, the fluid having a fluid-flow rate, and the well having a borehole and at least one casing string, comprising:

(i) circulating a process fluid through the casing interior and into an annular region outside the casing;

(ii) launching into the casing interior an apparatus for regulating fluid flow, the apparatus comprising: (a) a cementing plug fitted with at least one membrane; (b) an adjustable one-way valve incorporated inside the plug interior; and (c) a releasable device inside the plug interior, wherein the device is a ball that is expelled from the plug;

(iii) continuing to pump process fluid until the apparatus reaches and becomes lodged at the end of the casing string; and (iv) continuing to pump process fluid until the plug membrane ruptures, thereby allowing process fluid to enter the plug interior.

2. The method of claim 1, wherein the one-way valve is adjusted to limit the fluid-flow rate from the casing interior, through the plug interior, and into the annular region between the casing exterior and the borehole wall.

3. The method of claim 1, wherein one or more independent devices in the apparatus are adjusted to limit the fluid-flow rate from the casing interior, through the plug interior, and into the annular region between the casing exterior and the borehole wall, the independent devices comprising one or more members of the list comprising nozzles, orifices and valves.

4. The method of claim 1, wherein the flow-rate adjustment is performed before the apparatus is inserted into the well.

5. The method of claim 1, wherein the flow-rate adjustment is performed after the apparatus is inserted into the well.

6. A method for cementing a subterranean well, the well having a borehole and at least one casing string, comprising:

(i) circulating drilling fluid through the casing interior and into an annular region outside;

(ii) launching into the casing interior an apparatus for regulating fluid flow having a fluid-flow rate, the apparatus comprising: (a) a cementing plug fitted with at least one membrane; (b) an adjustable one-way valve incorporated inside the plug interior; and (c) a releasable device inside the plug interior, wherein the device is a ball that is expelled from the plug;

(iii) continuing to pump drilling fluid until the apparatus reaches and becomes lodged at the end of the casing string;

(iv) continuing to pump drilling fluid until the plug membrane ruptures, thereby allowing drilling fluid to enter the plug interior; and (v) pumping a desired volume of cement slurry into the casing interior, through the apparatus, and into an annular region outside the casing.

7. The method of claim 6, wherein the releasable device is expelled from the plug as process fluid enters the plug interior.

8. The method of claim 6, wherein the one-way valve is adjusted to limit the fluid-flow rate from the casing interior, through the plug interior, and into the annular region between the casing exterior and the borehole wall.

9. The method of claim 6, wherein one or more independent devices in the apparatus are adjusted to limit the fluid-flow rate from the casing interior, through the plug interior, and into the annular region between the casing exterior and the borehole wall, the independent devices comprising one or more members of the list comprising nozzles, orifices and valves.

10. The method of claim 6, wherein the flow-rate adjustment is performed before the apparatus is inserted into the well.

11. The method of claim 6, wherein the flow-rate adjustment is performed after the apparatus is inserted into the well.

* * * * *